US008485109B2

(12) United States Patent
Dietmaier et al.

(10) Patent No.: US 8,485,109 B2
(45) Date of Patent: Jul. 16, 2013

(54) METHOD FOR MINIMIZING TREAD DAMAGE AND PROFILE WEAR OF WHEELS OF A RAILWAY VEHICLE

(75) Inventors: Peter Dietmaier, Graz (AT); Martin Rosenberger, St. Ruprecht/Raab (AT); Klaus Six, Stainztal (AT)

(73) Assignee: Siemens AG Österreich, Vienna (AT)

( * ) Notice: Subject to any disclaimer, the term of this patent is extended or adjusted under 35 U.S.C. 154(b) by 305 days.

(21) Appl. No.: 12/664,112

(22) PCT Filed: May 20, 2008

(86) PCT No.: PCT/EP2008/056137

§ 371 (c)(1),
(2), (4) Date: Dec. 11, 2009

(87) PCT Pub. No.: WO2008/155185

PCT Pub. Date: Dec. 24, 2008

(65) Prior Publication Data

US 2010/0170415 A1 Jul. 8, 2010

(30) Foreign Application Priority Data

Jun. 19, 2007 (AT) ..... A 942/2007

(51) Int. Cl.
*B61D 1/00* (2006.01)

(52) U.S. Cl.
USPC ..... 105/166; 105/171; 105/168

(58) Field of Classification Search
USPC ..... 105/166, 168, 171, 174, 185–193
See application file for complete search history.

(56) References Cited

U.S. PATENT DOCUMENTS

| | | | | | |
|---|---|---|---|---|---|
| 4,175,494 | A * | 11/1979 | Moser | 105/176 |
| 4,289,075 | A * | 9/1981 | Smith | 105/4.4 |
| 4,519,329 | A * | 5/1985 | Vacher | 105/168 |
| 4,625,652 | A * | 12/1986 | Losa et al. | 105/4.1 |
| 4,679,506 | A * | 7/1987 | Goding et al. | 105/136 |
| 4,982,671 | A * | 1/1991 | Chollet et al. | 105/168 |
| 5,429,056 | A * | 7/1995 | Pees et al. | 105/168 |
| 5,456,184 | A * | 10/1995 | Fritz | 104/139 |
| 5,488,910 | A * | 2/1996 | Pees et al. | 105/166 |
| 6,363,861 | B1 * | 4/2002 | Strehler | 105/182.1 |
| 6,966,266 | B1 * | 11/2005 | Schwendt | 105/167 |
| 2009/0276107 | A1 * | 11/2009 | Reimann et al. | 701/19 |
| 2010/0170415 | A1 * | 7/2010 | Dietmaier et al. | 105/171 |
| 2010/0229753 | A1 * | 9/2010 | Kikko et al. | 105/4.4 |

FOREIGN PATENT DOCUMENTS

| | | | |
|---|---|---|---|
| EP | 0600172 | A1 | 6/1994 |
| EP | 0655378 | A1 | 5/1995 |
| EP | 0870664 | A2 | 10/1998 |
| EP | 1323610 | A1 | 7/2003 |
| EP | 1609691 | A1 | 12/2005 |

* cited by examiner

*Primary Examiner* — Jason C Smith

(57) ABSTRACT

A method for minimizing tread damage and profile wear of wheels of a railway vehicle is provided. The railway vehicle includes two sets of wheels, or a bogie of a railway vehicle with two sets of wheels, wherein setpoint values for parameters characterizing the position of a wheel relative to the track are determined based on measured values of a variable parameter relevant for the creation of tread damage and profile wear during the movement of the railway vehicle, on condition that the tread damage and profile wear on the wheels of the railway vehicle are minimized, wherein the position of one set of wheels is adjusted according to the setpoint values by means of actuation, control, or a combination of both.

16 Claims, 6 Drawing Sheets

FIG 4.1
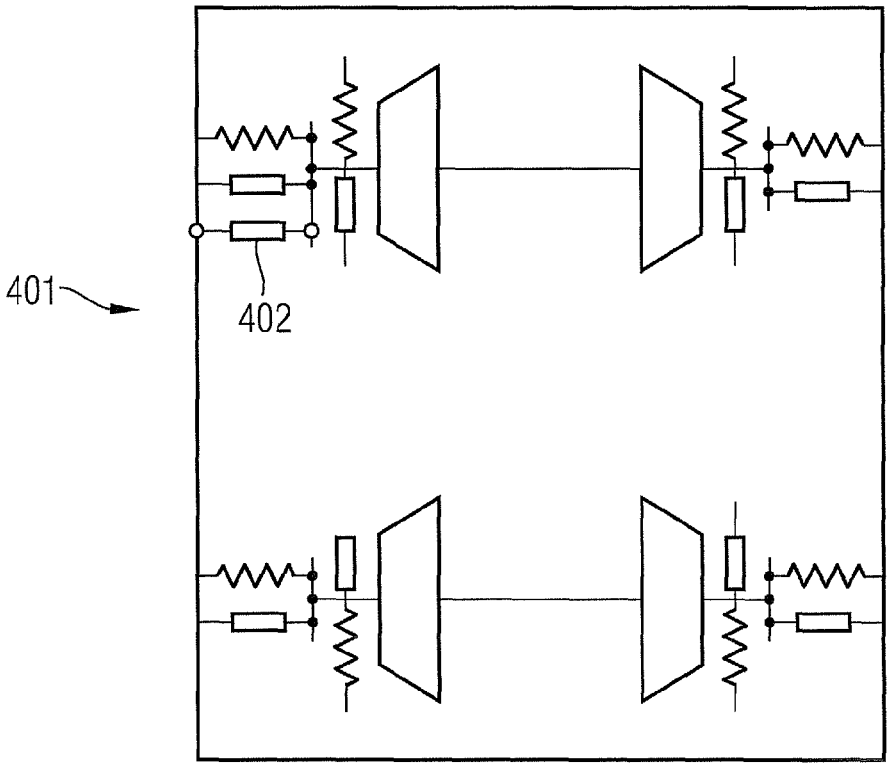
FIG 4.2
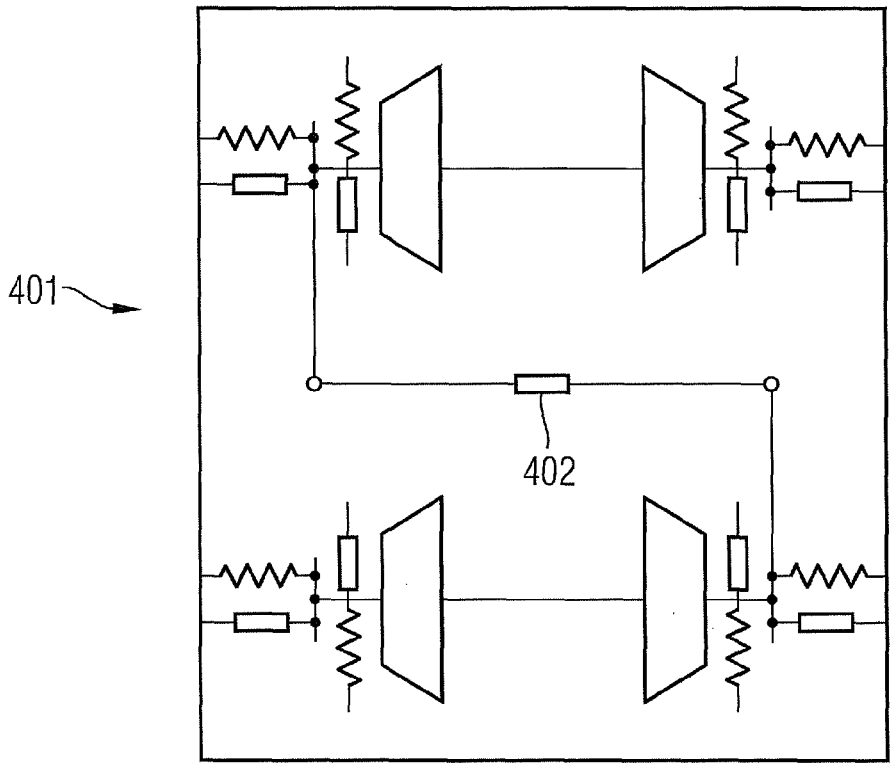

FIG 4.3
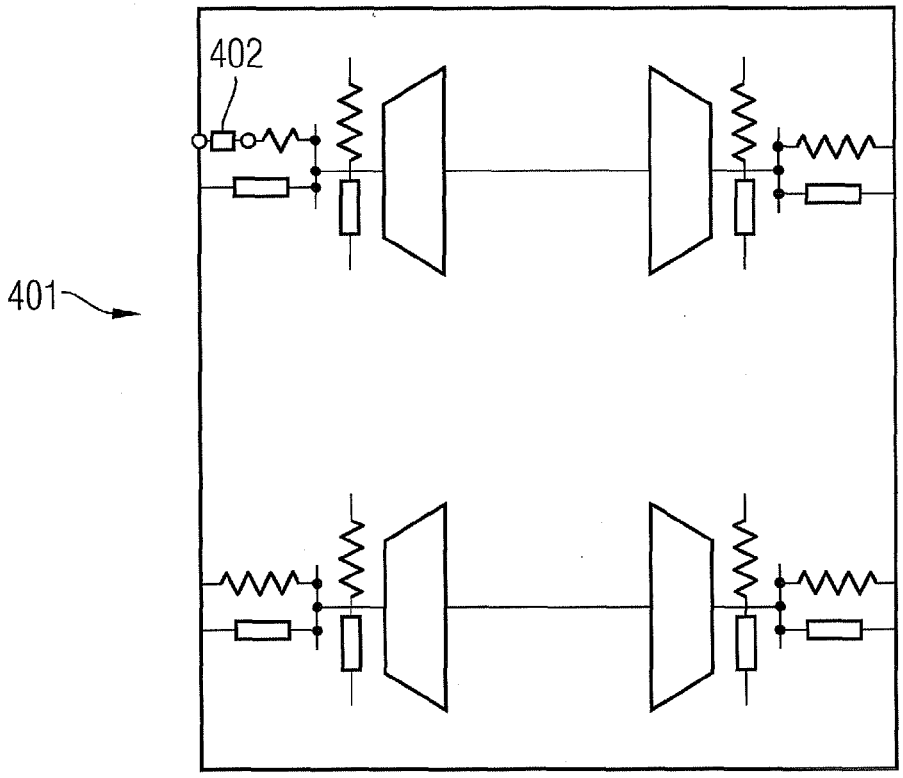
FIG 5.1
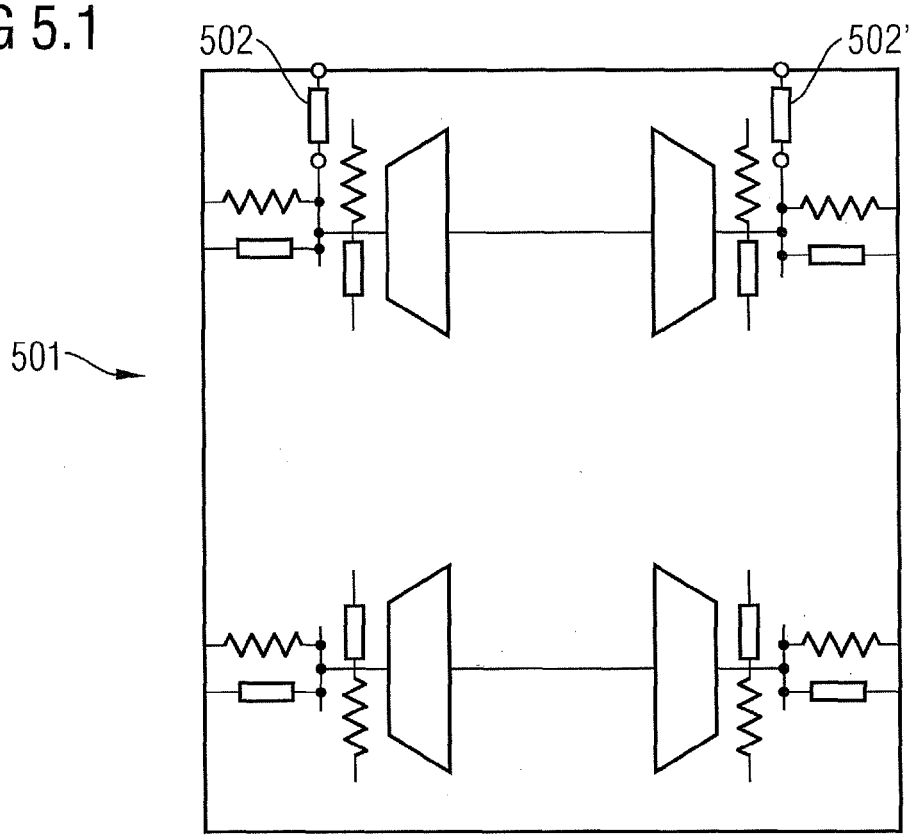

FIG 5.2
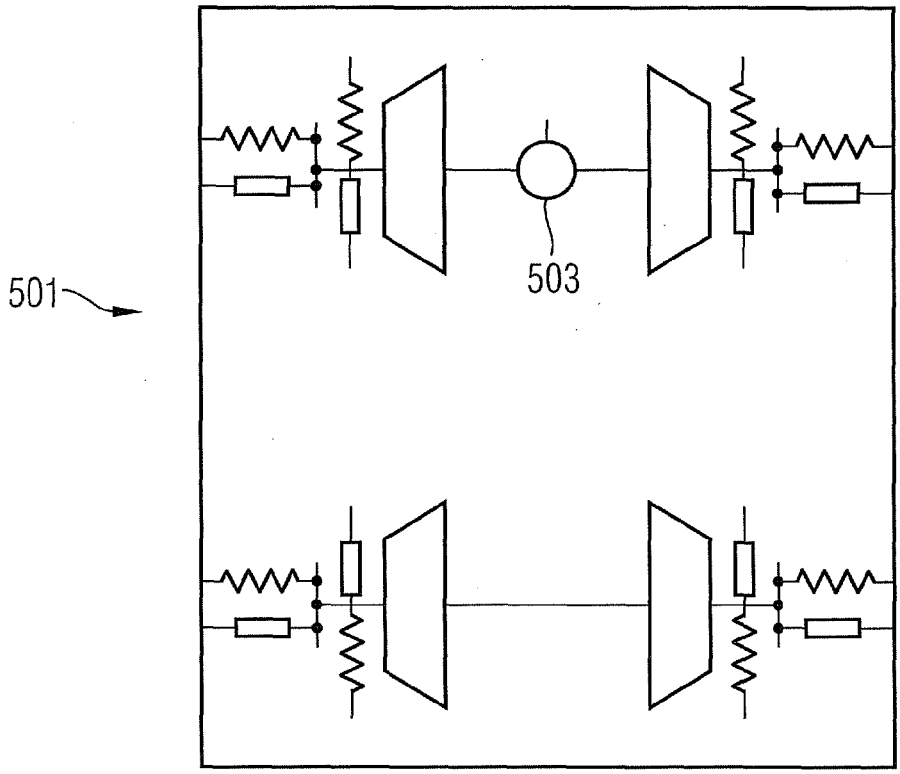
FIG 5.3
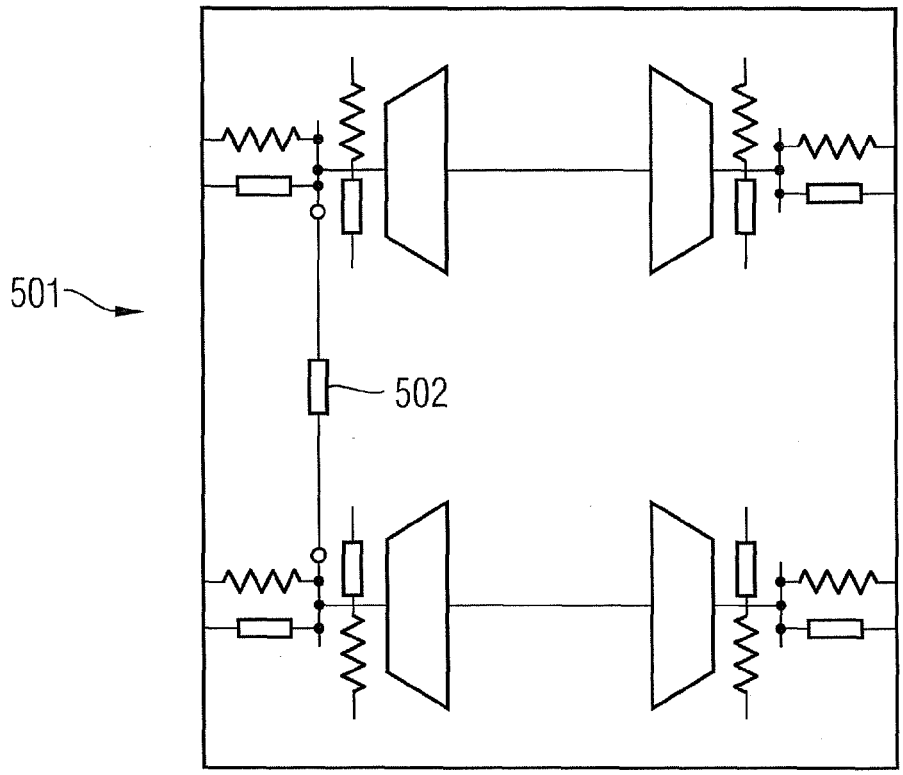

FIG 5.4
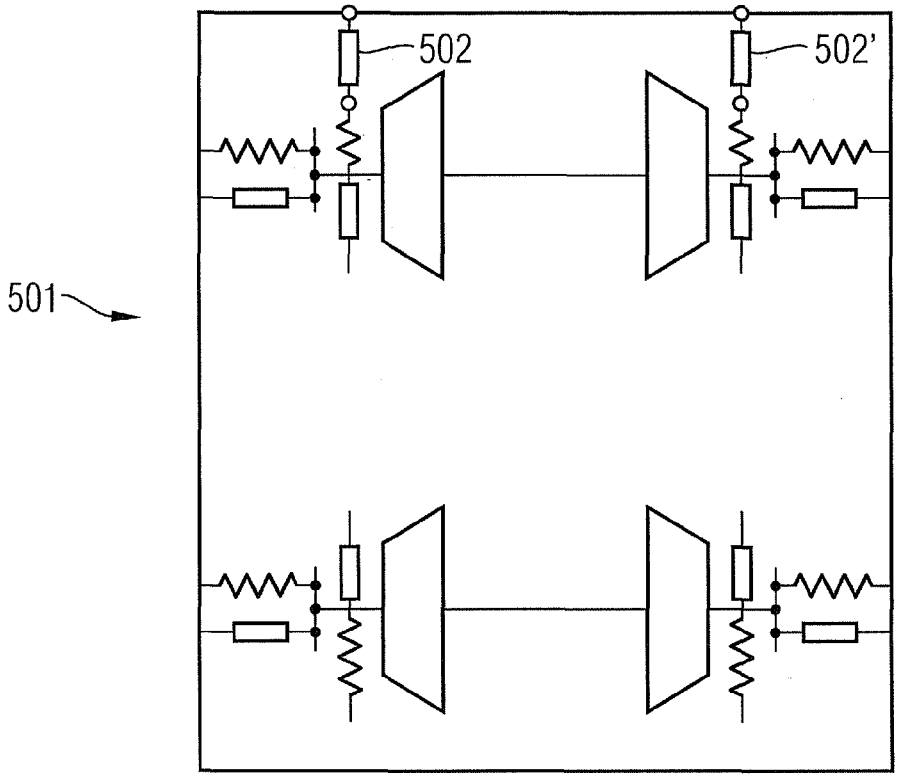
FIG 6
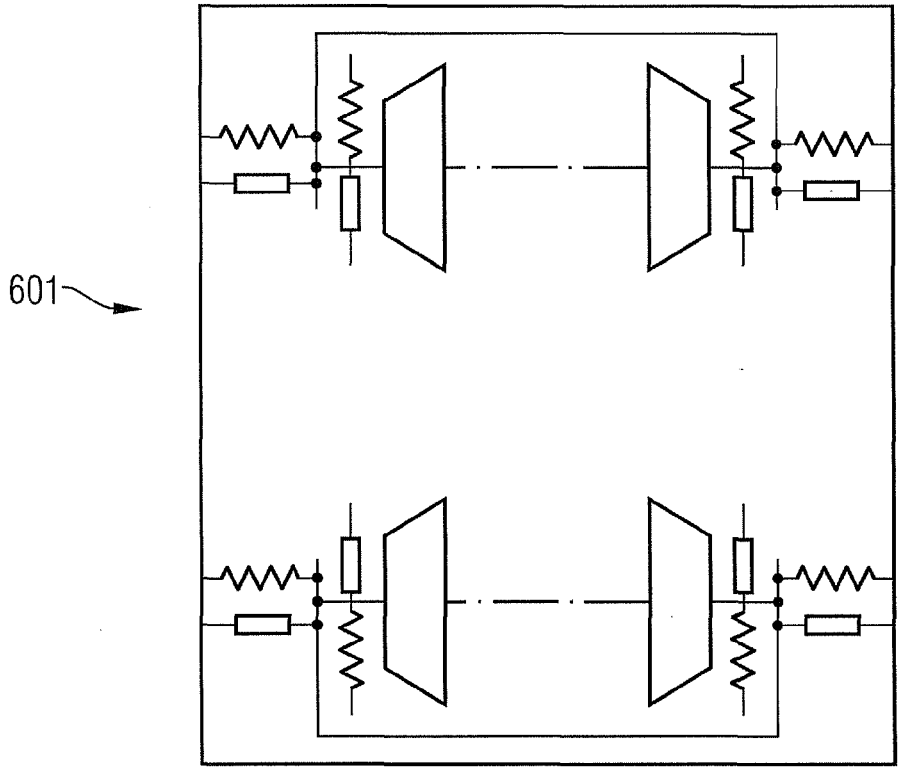

METHOD FOR MINIMIZING TREAD DAMAGE AND PROFILE WEAR OF WHEELS OF A RAILWAY VEHICLE

CROSS REFERENCE TO RELATED APPLICATIONS

This application is the US National Stage of International Application No. PCT/EP2008/056137 filed May 20, 2008, and claims the benefit thereof. The International Application claims the benefits of Austrian Application No. A942/2007 AT filed Jun. 19, 2007. All of the applications are incorporated by reference herein in their entirety.

FIELD OF INVENTION

The invention relates to a method for minimizing tread damage and profile wear of the wheels of a rail vehicle having at least two independently rotating wheelsets or at least two conventional wheelsets, or of a wheel truck (bogie) of a rail vehicle having at least two independently rotating wheelsets or at least two conventional wheelsets, wherein measurement data of at least one quantity which varies during the movement of the rail vehicle and is relevant to wheel/rail contact loading is recorded while the rail vehicle is traveling.

The invention also relates to a rail vehicle having at least two independently rotating wheelsets or at least two conventional wheelsets, or of a truck (bogie) of a rail vehicle having at least two independently rotating wheelsets or at least two conventional wheelsets for the application of the method according to the invention.

The term 'independently rotating wheelset' here refers to a pair of wheels which are mounted e.g. on a cross member and can rotate independently of one another, i.e. are not rigidly connected to one another. A conventional wheelset means a pair of wheels rigidly connected to one another via a wheelset shaft.

BACKGROUND OF INVENTION

It is well known that rail vehicles travel in a guided manner. The forces required for guidance are produced in the area of contact between wheel and rail, the wheel/rail contact. However, these forces are also responsible for negative effects on the rails and wheels. For example, tangential forces, which are always associated with sliding effects and therefore with friction, cause profile wear due to material abrasion. In addition, at sufficiently high levels, the forces acting on wheel and rail stress the material, resulting in rolling contact fatigue (RCF). This produces e.g. hairline cracks in the rail and/or wheel. A typical form of rail surface damage caused by RCF are head checks. In the wheel, cracks may occur below the surface, propagate outwards and lead to significant flaking. However, the cracks can also occur on the surface, propagate inwards and likewise result in material break-outs, as occurs e.g. with the well-known herringbone pattern phenomenon. In the case of surface initiated cracking, the effect occurs that the incipient cracks are partially removed again by the above mentioned profile wear, which means that a certain degree of profile wear may in some cases be desirable. In addition to the tread damage referred to above, a number of other types of damage such as e.g. wheel flats, material deposition, transverse cracks in the wheel tread, etc. also occur.

Wheel/rail contact therefore assumes particular safety-relevant importance also in the case of high-speed trains, for example. Wheel/rail contact irregularities caused e.g. by severe damage to a wheel may result in consequential damage or even derailment. However, even minor damage such as hairline cracks can cause major problems, as repairs will be required resulting in high costs and possible train service delays.

A number of mechanical devices for guiding a rail vehicle are therefore known. Many of the known systems are based on optimizing the radial position of the wheels in the track when negotiating curves in order to reduce the forces acting on the independently rotating wheelsets or conventional wheelsets of a wheel truck or vehicle, thereby reducing, so the argument goes, the friction and therefore the profile wear in the wheel/rail contact.

For example, EP 0 600 172 A1 describes a wheel truck for rail vehicles wherein the wheelsets are turned out with respect to the truck frame by means of force-controlled final control elements when negotiating curves. Here, however, no radial position of the wheelsets relative to the track is implemented, but only the angle between wheelset and truck frame is adjusted according to the radial position. Although this provides favorable wear behavior in many operating conditions, this is less than optimum.

DE 44 13 805 A1 discloses a self-steering three-axle wheel truck for a rail vehicle in which the two outer wheelsets are provided with a radial controller and the inner wheelset can be moved transversely to the direction of travel by an active final control element. This reduces the lateral forces on the outer wheelsets—when the active final control element is suitably acted upon, a third of the centrifugal force is exerted on each wheelset. This means that all three wheelsets are used for control when negotiating curves and the orientation of the wheelsets relative to the center of the curve is improved.

Another method of this kind may be found in EP 1 609 691 A1 of the Applicant.

The common feature of all these methods is that they aim to minimize wheel/rail contact friction and therefore profile wear. In these methods, the position of the wheels relative to the track is influenced such that sliding effects at the point of contact are prevented or minimized. However, rolling contact fatigue also results in rail and wheel damage. To rectify this damage, a degree of friction is quite desirable, as cracks produced in the material can be surface abraded thereby. Minimum friction does not therefore always correspond to an optimum rail/wheel loading ratio.

SUMMARY OF INVENTION

An object of the invention is to create a way of optimizing wheel/rail contact loading for a rail vehicle so as to maximize the service life of both the wheels and the rail. This object is achieved by minimizing the evaluated sum of rolling contact fatigue induced tread damage and profile wear.

This object is achieved according to the invention by a method of the kind mentioned in the introduction by determining setpoint values for parameters characterizing the position of at least one wheel relative to the track on the basis of at least one quantity which varies during the movement of the rail vehicle and is relevant to the occurrence of tread damage and profile wear, subject to the requirement that rail vehicle wheel tread damage and profile wear are minimized thereby, the position of the at least one independently rotating wheelset or conventional wheelset being set according to the setpoint values by means of open-loop control, closed-loop control or a combination of the two.

Quantities relevant to the occurrence of tread damage and profile wear which vary during the movement of a rail vehicle are, for example, vehicle speed, gross laden weight, driving and braking torques, track alignment data such as curve radius and cant, but also variables directly related to wheel/rail contact conditions such as contact geometry and coefficient of friction in the wheel/rail contact.

An advantage of the invention is that parameters characterizing the position of the wheels relative to the track are set taking the current state of the rail vehicle into account such that the tread damage and profile wear are jointly minimized or rather can be optimized for a specific situation. This takes place taking particular account of the damage caused by rolling contact fatigue and of the profile wear caused by friction. This also allows for the fact that, by means of somewhat increased friction, damage resulting from rolling contact fatigue can be rectified by abrasion.

For the possible measured values, the setpoint values of the parameters are advantageously calculated by means of a mathematical model describing the interaction between the rail vehicle and the track and stored in tables of a database, and the parameters to be currently set are taken from the tables of the database according to the measured values while the rail vehicle is traveling. The mathematical model used here can be, for example, a model for quasi-steady-state negotiation of a curve by a rail vehicle. By means of the described embodiment of the method according to the invention, the computational effort required while the rail vehicle is traveling can be kept within limits.

In another embodiment of the invention, on the basis of the measured values, the setpoint values for the parameters are calculated while the rail vehicle is traveling by an evaluation unit using a mathematical model describing the interaction between the rail vehicle and the track. The advantage of this embodiment is that no database needs to be used and the calculation is performed directly from the measured values. Moreover, the method is also much more flexible: whereas in the embodiment with the database, when adding additional variable, result-improving quantities whose measured values are used for calculating the setpoint values of the parameters, the database entries would also have to be re-calculated, here it is only necessary to change the mathematical model which involves much less time and effort.

Advantageously, the parameters characterizing the position of the at least one wheel relative to the track are the transverse displacement between at least one independently rotating wheelset or conventional wheelset axle and a wheel truck or vehicle frame and/or the angularity between at least one independently rotating wheelset or conventional wheelset axle and a wheel truck or vehicle frame. The parameters transverse displacement and angularity have the greatest influence on the occurrence of tread damage as the result of rolling contact fatigue and profile wear in the wheel/rail contact. In conventional methods, the transverse displacement sets itself automatically as a function of a number of parameters. The angularity also sets itself automatically in conventional methods or is set having regard to the profile wear behavior. The advantage of the method according to the invention is therefore that it additionally takes account of the damage caused by rolling contact fatigue. By means of open- or closed-loop control of the transverse displacement and/or angularity, the rolling contact fatigue and the friction can be jointly minimized or optimized depending on requirements, thereby enabling the service life of rail vehicle wheels to be specifically optimized.

In addition, the parameters which characterize the position of the at least one wheel relative to the track are the transverse displacement between at least one independently rotating wheelset or conventional wheelset axle and the at least one other independently rotating wheelset or conventional wheelset axle of the wheel truck or vehicle and/or the angularity between the at least two independently rotating wheelset or conventional wheelset axles of the wheel truck or vehicle.

In a preferred variant of the invention, the transverse displacement between at least one independently rotating wheelset or conventional wheelset axle and a wheel truck or vehicle frame or the transverse displacement between at least one independently rotating wheelset or conventional wheelset axle and the at least one other independently rotating wheelset or conventional wheelset axle of the wheel truck or vehicle is set by at least one first actuator and/or the angularity between at least one independently rotating wheelset or conventional wheelset axle and a wheel truck or vehicle frame or the angularity between the at least two independently rotating wheelset or conventional wheelset axles of the wheel truck or vehicle by at least one second actuator. Through the provision of such actuators for directly setting the values calculated or obtained from the database, the method according to the invention can be carried out in a particularly simple manner.

Advantageously, in the case of individual-wheel vehicles, a differential torque, superimposed on the driving and braking torques, between the wheels of an axle is provided as a manipulated variable for controlling the wheel position in the track. This enables a particular position of the wheels in the track to be achieved by predefining a differential torque, thereby conceivably obviating the need for an angle-setting actuator.

The object outlined above is also inventively achieved with a rail vehicle of the type mentioned in the introduction or a wheel truck of a rail vehicle of the type mentioned in the introduction in that at least one of the independently rotating wheelset or conventional wheelset axles can be displaced transversely with respect to a vehicle frame by means of at least one first actuator, the transverse displacement being determined according to one of the methods mentioned above and/or that the angle between at least one independently rotating wheelset or conventional wheelset axle and the vehicle frame can be set by at least one second actuator, the angle being determined according to one of the methods mentioned above.

In a variant of the invention, at least one of the independently rotating wheelset or conventional wheelset axles can be displaced transversely by means of at least one first actuator with respect to the at least one other independently rotating wheelset or conventional wheelset axle of the vehicle, the transverse displacement being determined according to one of the methods mentioned above and/or the angle between the at least two independently rotating wheelset or conventional wheelset axles can be set by at least one second actuator, the angle being determined according to one of the methods mentioned above.

It is advantageous here if the above mentioned actuators are implemented as hydraulic, pneumatic or electromechanical final control elements. Such actuators are relatively simple to manufacture and have long been used for other applications, so that their operation and the solution of any problems occurring are well known.

BRIEF DESCRIPTION OF THE DRAWINGS

The invention together with further advantages will now be explained in greater detail with reference to a number of non-limiting exemplary embodiments illustrated in the accompanying schematic drawings in which:

FIG. 6 shows an example of a wheel truck of a rail vehicle having two independently rotating wheelsets.

DETAILED DESCRIPTION OF INVENTION

Figure 1:
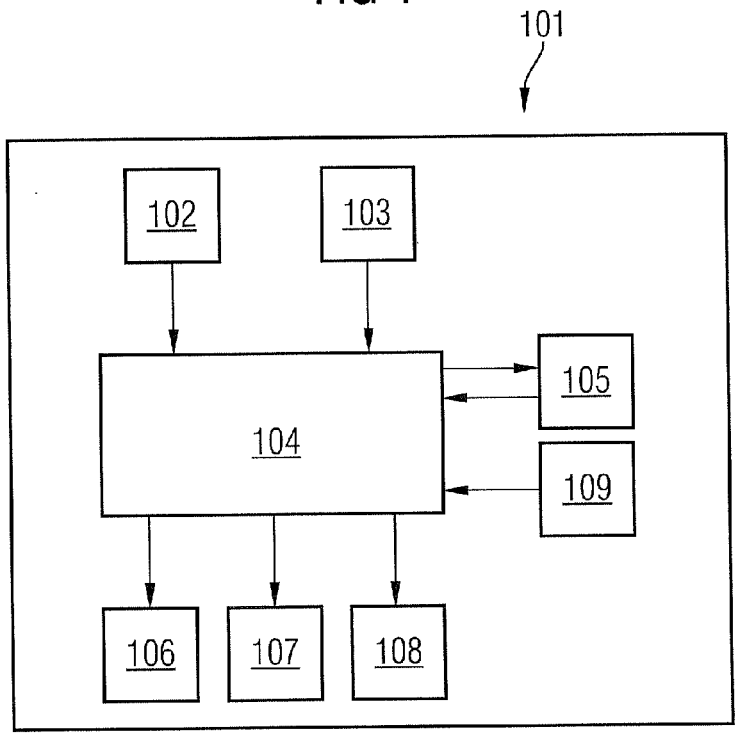
FIG. 1 shows a block diagram for clarifying the method according to the invention, FIG. 2 schematically illustrates a rail vehicle.

FIG. 1 is a block diagram illustrating the mode of operation of the method according to the invention with reference to a rail vehicle 101. This can be any rail vehicle, e.g. one with two or more conventional wheelsets or independently rotating wheelsets, the method also being applicable to a wheel truck of a rail vehicle having at least two conventional wheelsets or independently rotating wheelsets. In this example, the mode of operation will be described on the basis of a rail vehicle 101 having two conventional wheelsets. Each wheelset consists of a wheelset shaft and two wheel disks which are more or less rigidly connected to the shaft; conversely, with an independently rotating wheelset the wheel disks can rotate independently of one another.

While the rail vehicle is traveling, measured values of at least one quantity which varies while the rail vehicle 101 is traveling and is relevant to the occurrence of tread damage are recorded using at least one sensor 102, 103. This variable can be, for example, aligmnent data such as curve radius or cant, rail/wheel contact characteristics but also vehicle speed, gross laden weight, driving and braking torques or lateral acceleration. The lateral acceleration can either be measured directly or calculated from other variables (e.g. from the speed, the curve radius and the cant). For the application of the method according to the invention described below, the lateral acceleration and the curve radius are measured. Other variable quantities can be optionally selected from the above mentioned possibilities. For the method according to the invention, it would basically suffice to measure only the curve radius with a sensor.

For each combination of values of these variable quantities there is a position of the wheels relative to the track in which the evaluated sum of the anticipated tread damage and the profile wear caused by the friction occurring is at its lowest. Tread damage is here understood as meaning in particular damage due to rolling contact fatigue (RCF) which manifests itself e.g. as herringbone patterns and flaking on the wheel and in the form of head checks on the rail. In addition to a position in which the tread damage and profile wear are at their lowest overall, there are of course also wheel positions in which either the anticipated tread damage or the profile wear are even lower when considered per se. Basically therefore, by predefining a particular position of the wheels relative to the track, a particular overall damage or wear behavior can be set. For example, on sections with tight curve radii the profile wear is relatively high due to the high friction, while RCF is somewhat less significant. The position of the wheels relative to the track can then be set such that this fact can be taken into account.

Figure 2:
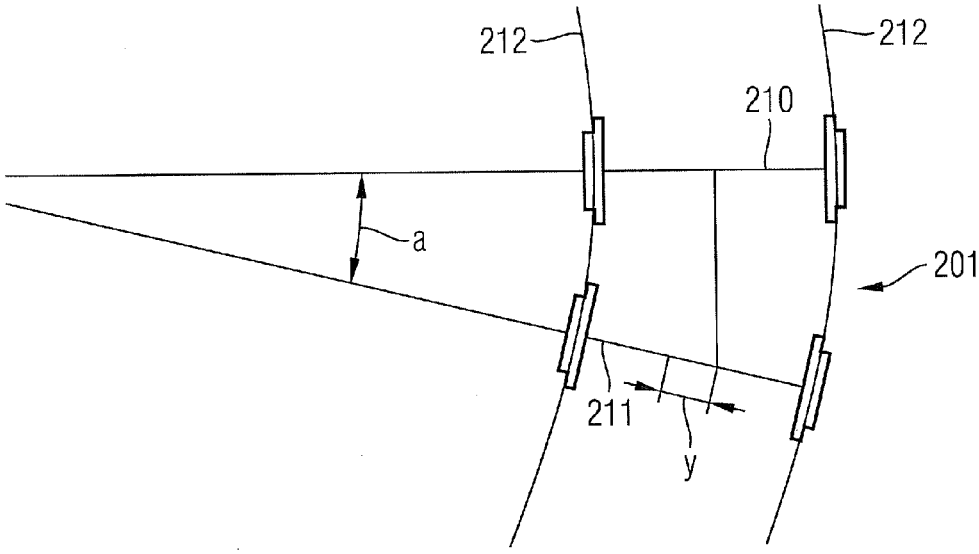

The measured values of the variable quantity are transmitted to an evaluator 104 which determines setpoint values for parameters characterizing the position of the wheels relative to the track on the basis of said measured values. In this example, these setpoint values are the angle $\alpha$ between the two wheelset axles and the transverse displacement y of the wheelset axles relative to one another. For better understanding, FIG. 2 schematically illustrates a rail vehicle 201 having a first conventional wheelset 210 and a second conventional wheelset 211 on a short section of track with two rails 212, said rails 212 describing an arc with a particular radius. The wheelsets 210, 211 are at an angle $\alpha$ to one another; in addition, a transverse displacement y of the second wheelset 211 with respect to the first wheelset 210 is implemented. For the sake of completeness it should be mentioned that to illustrate the above parameters only the parts of the rail vehicle 201 that are most important for the explanation are shown and the angle $\alpha$ and transverse displacement y are depicted exaggeratedly large. Basically all kinds of parameters can be used, e.g. even the angle between an independently rotating wheelset or conventional wheelset axle and the vehicle or wheel truck frame or the transverse displacement of an independently rotating wheelset or conventional wheelset axle with respect to the vehicle or wheel truck frame. In FIG. 1, at least two actuators 106, 107 are provided for setting the determined setpoint values of the parameters.

A first actuator 106 sets the angle $\alpha$, a second actuator 107 sets the transverse displacement y. The actuators 106, 107 can be of different types, e.g. hydraulic, pneumatic or electromechanical final control elements.

The setpoint values of the parameters are set using the actuators 106, 107 described, by means of either open- or closed-loop control. This produces the position of the vehicle/wheel truck in the track. For vehicles with independently rotating wheelsets, an additional control loop is basically required, as in that case the above mentioned position in the track is very sensitive to small disturbances. For this reason, as an additional manipulated variable for the control loop, a differential torque superimposed on the driving and braking torques is provided with which the effects of the disturbances can be compensated. Such a differential torque is produced using at least one additional drive module 108.

The setpoint values of the parameters characterizing the position of the wheels relative to the track can be determined in different ways in the evaluator 104, the procedure adopted depending not least on how the damage caused by rolling contact fatigue and the profile wear are assessed relative to one another. In this example, the friction produced is calculated for the profile wear due to material abrasion, the damage caused by RCF being determined by means of the model of Anders Ekberg et al. This model is described in "*An engineering model for prediction of rolling contact fatigue of railway wheels*", Anders Ekberg et al. (Fatigue Fract. Engng. Mater. Struct. 25, 2002, 899-909).

In this model, three types of RCF are described: 'surface-initiated fatigue' (hereinafter referred to as surface RCF) which results from severe plastic deformation on the material surface and manifests itself in the occurrence of incipient cracks on the surface and subsequently in flaking of the tread material; 'subsurface-initiated fatigue' (hereinafter referred to as subsurface RCF) which can lead to incipient cracking under the surface and eventually to massive flaking; 'fatigue initiated at deep material defects'. In this example, only the first two types of RCF, i.e. surface RCF and subsurface RCF, are covered in greater detail.

Surface RCF is quantified using a surface RCF index $FI_{obf}$ which is essentially determined from the normalized vertical load v and the utilized friction coefficient. For subsurface RCF, a subsurface RCF index $FI_{sub}$ can likewise be calculated.

In order now to be able to estimate, in this example, the tread damage caused by RCF and the profile wear caused by friction which are to be expected for particular values of the parameters characterizing the position of the wheels relative to the track, the above mentioned indices and the friction must be determined for the respective values of the parameters.

In a first method for determining the angle α and the transverse displacement y in the evaluator 104, the setpoint values for angle α and transverse displacement y are obtained from a database 105 on the basis of the measured values of the variable quantities measured by the sensors 102, 103, the entries for the database 105 being calculated 'offline', i.e. prior to the running of the rail vehicle 101, from possible values of the variable quantities by means of an algorithm containing the mathematical model. The appropriate pairing of angle α and transverse displacement y is determined by looking for the optimum pairing for the damage caused by surface RCF and subsurface RCF and for profile wear and then determining the overall optimum. The optimum pairing is to be understood as the pairing for which the anticipated damage or profile wear are as low as possible. The pairing which is then stored in the database 105 for the measured values of the variable quantities is the one for which the individual damage effects are as low as possible.

However, a pairing can also be determined for which the friction is minimized and therefore somewhat greater damage caused by surface and subsurface RCF is acceptable or damage caused by surface RCF can be minimized with simultaneously somewhat greater friction and subsurface RCF. The database entries of the pairing of angle α and transverse displacement y can be determined for these or any other requirements.

Basically, for a rail vehicle with two conventional wheelsets, as described here, there is, for each wheel/rail contact, a pairing of angle α and transverse displacement y for which the tread damage and profile wear are at their lowest. However, as each wheel cannot be adjusted individually, a pairing is generally selected in which minimum tread damage and minimum profile wear occur for all wheel/rail contacts. This can be done e.g. by selecting the pairing for which the maximum evaluated sum of damage and profile wear assumes a minimum across all rail/wheel contacts. In this case this means that the friction, the surface RCF index $FI_{obf}$ and the subsurface RCF index $FI_{sub}$ would be at their lowest for the most heavily stressed wheel. In a variant, the pairing for which the sum of the evaluated sums of damage and profile wear across all wheel/rail contacts assumes a minimum can also be selected.

Figure 3:
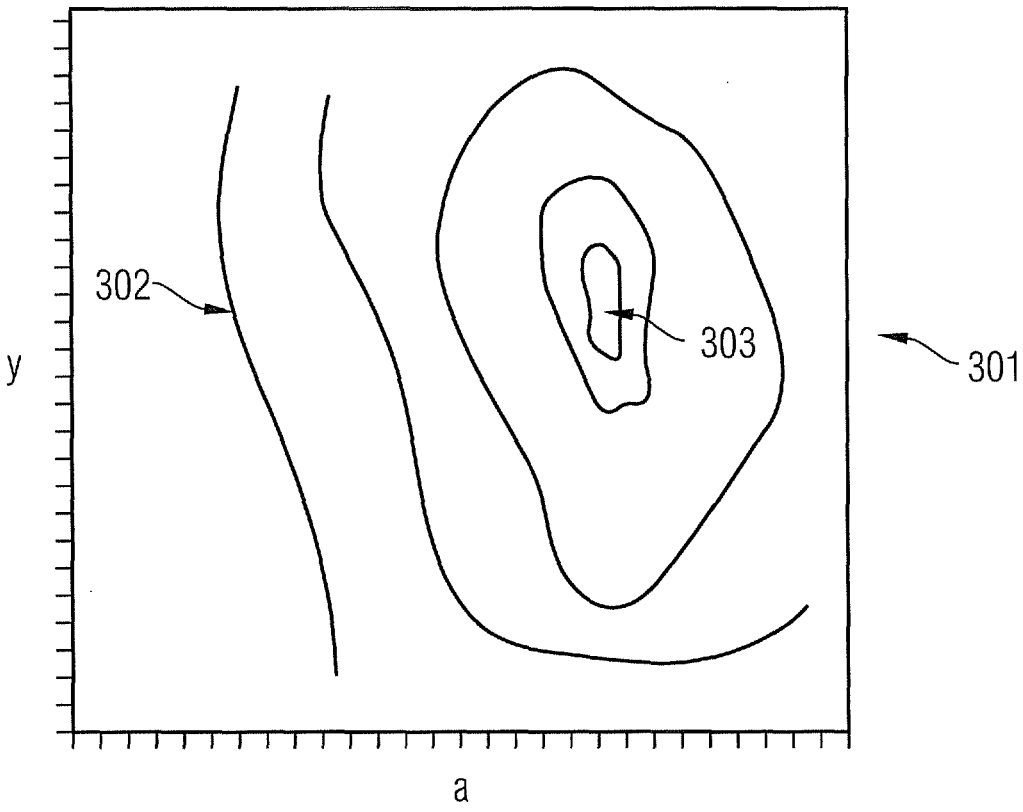
FIG. 3 shows a 'surface RCF index map', FIGS. 4.1 to 4.3 show by way of example a wheel truck of a rail vehicle with two conventional wheelsets with one or more actuators for setting a transverse displacement, FIGS. 5.1 to 5.4 show a wheel truck from FIGS. 3.1 to 3.3 with one or more actuators for setting an angle.

To make the procedure clear, FIG. 3 shows a typical calculation result in the foam of a 'surface RCF index map' 301, i.e. a surface RCF index e.g. for particular values of the variable quantities for any pairing of angle α and transverse displacement y. The map 301 enables the response of the surface RCF index to be identified by means of contour lines 302. The optimum pairing of angle α and transverse displacement y, i.e. for which the surface RCF index would be minimum, is identifiable as a point 303. This pairing would be stored in the database 105 mentioned in FIG. 1 for the values of the variable quantity on which the calculation is based.

Just as optimum pairings of angle α and transverse displacement y can be identified on the 'surface RCF index' map, such pairings can also be determined for subsurface RCF index and friction. In addition to the methods in which the database 105 is created 'offline', there is also an additional method in which the setpoint values of the parameters such as angle α and transverse displacement y are determined 'online'. In this case, the optimum pairing of angle α and transverse displacement y is determined in the evaluator 104 while the vehicle is traveling on the basis of the measured values of the variable quantities. As such a method is relatively compute-intensive, the 'offline' method is preferred where possible.

In a further variant, the determination of the measured variable by means of sensors 102, 103 can be supplemented by an additional position database 109, with alignment data such as e.g. curve radius and cant being stored in said position database 109. Then, if one of the sensors 102, 103 is a GPS sensor which determines the position of the rail vehicle 101 using a satellite positioning system such as GPS or Galileo, the corresponding alignment data can be obtained from the position database 109 on the basis of said positioning data.

The actuators 106, 107 can be arranged in different configurations. FIGS. 4.1 to 4.2 show by way of example a wheel truck of a rail vehicle 401 having two conventional wheelsets and an actuator 402 with which a transverse displacement of a wheelset can be implemented. In FIG. 4.1, a wheelset can be displaced transversely with respect to the truck frame. In FIG. 4.2, a transverse displacement of one wheelset with respect to the other can be implemented, while FIG. 4.3 shows another variant of transverse displacement of a wheelset with respect to the truck frame.

FIGS. 5.1 to 5.4 shows by way of example a wheel truck of a rail vehicle 501 having two conventional wheelsets and one or more actuators 502, 502', 502", 503 with which an angularity can be implemented. FIG. 5.1 shows a variant in which an angle between the wheelset and the truck frame is implemented using an actuator 502 and optionally a second actuator 502'. In FIG. 5.2 the angle is set using an angular actuator 503 which is disposed on the axle of the wheelset. In FIG. 5.3, an angle between the wheelsets of the truck 501 is set by means of an actuator 502. In FIG. 5.4, another variant of setting the angle of a wheelset with respect to the truck frame is implemented.

The variants shown in FIGS. 4.1 to 4.3 and FIGS. 5.1 to 5.4 are of course to be understood as examples only, various other variants being conceivable. The above arrangements can also be implemented for vehicles with independently rotating wheelsets, after adaptation to the specific features of such vehicles. To facilitate understanding, FIG. 6 shows a wheel truck of a rail vehicle 601 having two independently rotating wheelsets. In FIG. 6, no actuators for setting the angle or the transverse displacement are installed, although these can essentially be mounted as shown in FIGS. 4.1 to 5.4.

The invention claimed is:

1. A method for minimizing tread damage and profile wear of wheels of a rail vehicle with at least two wheelsets, each wheelset including a wheelset axle, comprising:

providing a sensor;

determining setpoint values for parameters characterizing a position of a wheel relative to a track based upon measured values of a quantity which varies while the rail vehicle is traveling and which is relevant to the occurrence of tread damage and profile wear, wherein the sensor measures a curve radius, and wherein a lateral acceleration is measured while the rail vehicle is traveling; and minimizing tread damage and profile wear on the wheels of the rail vehicle according to the determined setpoint values, wherein the position of at least one wheelset is set according to the setpoint values by an open-loop control, closed-loop control or a combination thereof.

2. The method as claimed in claim 1, wherein the two wheelsets are two independently rotating wheelsets.

3. The method as claimed in claim 1, wherein the rail vehicle is a wheel truck.

4. The method as claimed in claim 1, further comprising:

calculating the setpoint values of the parameters by a mathematical model describing an interaction between the rail vehicle and the track;

storing the setpoint values in tables of a database; and obtaining the parameters currently to be set from the tables of the database according to the measured values while the rail vehicle is traveling.

5. The method as claimed in claim 1, further comprising:

calculating the setpoint values for the parameters while the rail vehicle is traveling by an evaluation unit using a mathematical model describing an interaction between the rail vehicle and the track.

6. The method as claimed in claim 1, wherein one of the parameters characterizing the position of the wheel relative to the track is the transverse displacement between at least one wheelset axle and a vehicle frame.

7. The method as claimed in claim 1, wherein one of the parameters characterizing the position of the wheel relative to the track is the angularity between at least one wheelset axle and a vehicle frame.

8. The method as claimed in claim 1, wherein the parameters characterizing the position of the wheel relative to the track are the transverse displacement between at least one wheelset axle and a vehicle frame and the angularity between at least one wheelset axle and a vehicle frame.

9. The method as claimed in claim 8, wherein the transverse displacement between the at least one wheelset axle and the vehicle frame is set by a first actuator and the angularity between the at least wheelset axle and the vehicle frame is set by a second actuator.

10. The method as claimed in claim 1, wherein one of the parameters characterizing the position of the wheel relative to the track is the transverse displacement between a first wheelset axle and a second wheelset axle of the rail vehicle.

11. The method as claimed in claim 1, wherein one of the parameters characterizing the position of the wheel relative to the track is the angularity between a first wheelset axle and second wheelset axle of the rail vehicle.

12. The method as claimed in claim 1, wherein the parameters characterizing the position of the wheel relative to the track are the transverse displacement between a first wheelset axle and a second wheelset axle of the rail vehicle and the angularity between the first and second wheelset axle.

13. The method as claimed in claim 12, wherein the transverse displacement between the first wheelset axle and the second wheelset axle of the rail vehicle is set by a first actuator and the angularity between the first and second wheelset axles of the rail vehicle is set by a second actuator.

14. A rail vehicle, comprising:

a vehicle frame;

a first actuator;

a second actuator;

a sensor; and two wheelsets, each wheelset including a wheelset axle, wherein the sensor measures a curve radius, and wherein a lateral acceleration is measured while the rail vehicle is traveling;

wherein one of the wheelset axles is displaced transversely with respect to the vehicle frame by the first actuator, or wherein an angle between one of the wheelset axles and the vehicle frame is set by the second actuator.

15. The rail vehicle as claimed in claim 14, wherein the actuators are hydraulic, pneumatic or electromechanical control elements.

16. The rail vehicle as claimed in claim 14, wherein the two wheelsets are two independently rotating wheelsets.

* * * * *